US009631393B2

(12) United States Patent
Zeigler

(10) Patent No.: US 9,631,393 B2
(45) Date of Patent: Apr. 25, 2017

(54) STRUCTURAL MODULE WITH STOP, COLLAPSIBLE STRUCTURE, AND METHOD OF ERECTING A COLLAPSIBLE STRUCTURE

(75) Inventor: Theodore R. Zeigler, Alexandria, VA (US)

(73) Assignee: World Shelters, Inc., Alexandria, VA (US)

( * ) Notice: Subject to any disclaimer, the term of this patent is extended or adjusted under 35 U.S.C. 154(b) by 1239 days.

(21) Appl. No.: 13/113,704

(22) Filed: May 23, 2011

(65) Prior Publication Data

US 2012/0298162 A1 Nov. 29, 2012

(51) Int. Cl.
*E04H 15/50* (2006.01)
*E04H 15/18* (2006.01)

(52) U.S. Cl.
CPC ..... *E04H 15/18* (2013.01); *E04H 15/50* (2013.01)

(58) Field of Classification Search
USPC ..... 135/131, 145, 146; 52/646
See application file for complete search history.

(56) References Cited

U.S. PATENT DOCUMENTS 3,968,808 A 7/1976 Zeigler
4,026,313 A 5/1977 Zeigler
4,193,414 A * 3/1980 Trochman ..... E04H 15/50 135/145
4,280,521 A 7/1981 Zeigler
4,290,244 A 9/1981 Zeigler
4,334,660 A 6/1982 Zeigler
4,437,275 A 3/1984 Zeigler
RE31,565 E * 4/1984 Beaulieu ..... E04H 15/50 135/145
4,473,986 A 10/1984 Zeigler
4,512,097 A 4/1985 Zeigler
4,522,008 A 6/1985 Zeigler
4,561,618 A 12/1985 Zeigler
4,579,066 A 4/1986 Zeigler
4,637,180 A 1/1987 Zeigler
4,689,932 A 9/1987 Zeigler
(Continued)

OTHER PUBLICATIONS

International Search Report and Written Opinion (Jul. 26, 2012) corresponding International App. PCT/US2012/037407.

*Primary Examiner* — Noah Chandler Hawk
(74) *Attorney, Agent, or Firm* — WRB-IP LLP

(57) ABSTRACT

A structural module includes a first strut pair including a first strut and a second strut pivotably connected to each other at a first strut pair pivotable connection point, a second strut pair including a third strut and a fourth strut pivotably connected to each other at a second strut pair pivotable connection point, a first hub, a first end of the first strut and a first end of the third strut being pivotably connected to the first hub, a second hub, a first end of the second strut and a first end of the fourth strut being pivotably connected to the second hub, and a stop arrangement attached to at least one of the first hub, the first strut, and the third strut, the stop arrangement including an abutment end. The structural module is movable between a closed position in which longitudinal axes of struts of the first strut pair and the second strut pair are substantially parallel to one another. A collapsible structure and a method of erecting a collapsible structure are also disclosed.

15 Claims, 10 Drawing Sheets

(56) References Cited

U.S. PATENT DOCUMENTS

| | | | | | |
|---|---|---|---|---|---|
| 4,747,239 | A | | 5/1988 | Zeigler | |
| 4,761,929 | A | | 8/1988 | Zeigler | |
| 4,800,663 | A | | 1/1989 | Zeigler | |
| 4,838,003 | A | | 6/1989 | Zeigler | |
| 4,885,891 | A | * | 12/1989 | Lynch | 52/646 |
| 4,970,841 | A | | 11/1990 | Zeigler | |
| RE33,710 | E | | 10/1991 | Zeigler | |
| 5,230,196 | A | | 7/1993 | Zeigler | |
| 5,274,980 | A | | 1/1994 | Zeigler | |
| 5,444,946 | A | | 8/1995 | Zeigler | |
| 5,651,228 | A | | 7/1997 | Zeigler | |
| 6,141,934 | A | | 11/2000 | Zeigler | |
| 6,772,780 | B2 | | 8/2004 | Price | |
| 7,357,238 | B2 | | 4/2008 | Zeigler | |
| 7,455,164 | B2 | | 11/2008 | Zeigler | |
| 7,478,644 | B2 | | 1/2009 | Zeigler | |
| 7,533,498 | B2 | | 5/2009 | Zeigler | |
| 7,556,054 | B2 | | 7/2009 | Zeigler | |
| 7,712,261 | B2 | | 5/2010 | Zeigler | |
| 7,832,170 | B2 | | 11/2010 | Zeigler | |

* cited by examiner

STRUCTURAL MODULE WITH STOP, COLLAPSIBLE STRUCTURE, AND METHOD OF ERECTING A COLLAPSIBLE STRUCTURE

BACKGROUND AND SUMMARY

The present invention relates to collapsible structures and, more particularly, to such structures including pivotable strut pairs that include stops for limiting pivotable movement of the struts.

A variety of types of collapsible structures (also often referred to as folding frame systems) are known. My U.S. Pat. No. 7,712,261, and my U.S. Pat. No. 7,556,054, which are incorporated by reference, disclose folding frame systems which can be locked in place by what can be referred to as a "tension lock". In this tension lock arrangement, the frame is locked in an open position by pivotably connected strut members that are foldable from a parallel folded condition in which the struts lie substantially against each other, through a parallel open condition in which the struts are disposed substantially end-to-end, to an open locked condition slightly beyond the latter parallel condition beyond which the struts are prevented from pivoting. In this open locked condition, when a tension member is connected between points on the two struts removed from the pivot points, the tension member will prevent the struts from passing back to the parallel open or parallel folded positions unless the tension member is released or the struts are somehow deformed.

My U.S. Pat. Nos. 5,230,196, 5,444,946, and 6,141,934, which are incorporated by reference, disclose embodiments of folding frame systems with what can be referred to as "manual locks". In these systems, strut pairs are arranged in scissor fashion, and, when the scissors are unfolded to open the system from a closed condition, ends of the struts are connected by hub portions that are manually locked together.

To simplify the construction of and erection and breakdown of folding frame systems, it is desirable to provide a folding frame system that does not require a tension lock or a manual lock.

A structural module according to an aspect of the present invention comprises a first strut pair comprising a first strut and a second strut pivotably connected to each other at a first strut pair pivotable connection point, a second strut pair comprising a third strut and a fourth strut pivotably connected to each other at a second strut pair pivotable connection point, a first hub, a first end of the first strut and a first end of the third strut being pivotably connected to the first hub, a second hub, a first end of the second strut and a first end of the fourth strut being pivotably connected to the second hub, and a stop comprising a first and a second stop strut pivotably connected to each other proximate first ends thereof to at least partially define an abutment end of the stop, the first stop strut being pivotably connected at a second end thereof to the first strut and the second stop strut being pivotably connected at a second end thereof to the third strut. The structural module is movable between a closed position in which longitudinal axes of struts of the first strut pair and the second strut pair are substantially parallel to one another and an open position in which the abutment end of the stop contacts the second hub.

A collapsible structure according to an aspect of the present invention comprises a plurality of strut pairs, each strut pair comprising a front strut and a rear strut pivotably connected to each other at a strut pair pivotable connection point, a plurality of hub pairs, each hub pair comprising an outer hub and an inner hub, at least one first hub pair of the plurality of hub pairs being connected to at least a first and a second strut pair of the plurality of strut pairs so that an outer hub of the at least one first hub pair is pivotably connected to front struts of the first and second strut pair and an inner hub of the at least one first hub pair is pivotably connected to rear struts of the first and second strut pair, and a stop associated with at the at least one first hub pair, the stop comprising a first and a second stop strut pivotably connected to each other proximate first ends thereof, the first and the second stop strut being pivotably connected at second ends thereof to one of the front strut and the rear strut of the first and second strut pair, respectively.

A structural module according to another aspect of the present invention comprises a first strut pair comprising a first strut and a second strut pivotably connected to each other at a first strut pair pivotable connection point, a second strut pair comprising a third strut and a fourth strut pivotably connected to each other at a second strut pair pivotable connection point, a first hub, a first end of the first strut and a first end of the third strut being pivotably connected to the first hub, a second hub, a first end of the second strut and a first end of the fourth strut being pivotably connected to the second hub, and a stop arrangement attached to at least one of the first hub, the first strut, and the third strut, the stop arrangement including an abutment end. The structural module is movable between a closed position in which longitudinal axes of struts of the first strut pair and the second strut pair are substantially parallel to one another and an open position in which the abutment end of the stop contacts the second hub.

A method of erecting a collapsible structure according to an aspect of the present invention is also provided. The method involves use of a collapsible structure comprising a plurality of strut pairs, each strut pair comprising a front strut and a rear strut pivotably connected to each other at a strut pair pivotable connection point, a plurality of hub pairs, each hub pair comprising an outer hub and an inner hub, at least one first hub pair of the plurality of hub pairs being connected to at least a first and a second strut pair of the plurality of strut pairs to form a series of strut pairs so that an outer hub of the at least one first hub pair is pivotably connected to front struts of the first and second strut pair and an inner hub of the at least one first hub pair is pivotably connected to rear struts of the first and second strut pair, and a stop associated with at the at least one first hub pair, the stop comprising a first and a second stop strut pivotably connected to each other proximate first ends thereof, the first and the second stop strut being pivotably connected at second ends thereof to one of the front strut and the rear strut of the first and second strut pair, respectively. The method comprises moving each strut pair from a collapsed position in which the front and rear strut of each strut pair are substantially parallel to each other and hubs of the first hub pair are at a greatest possible distance from each other to an open position in which the stop prevents hubs of the first hub pair from moving closer to each other and after each strut pair is in an open position, restraining relative movement of the strut pairs of the series of strut pairs without locking inner and outer hubs to each other.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1A:
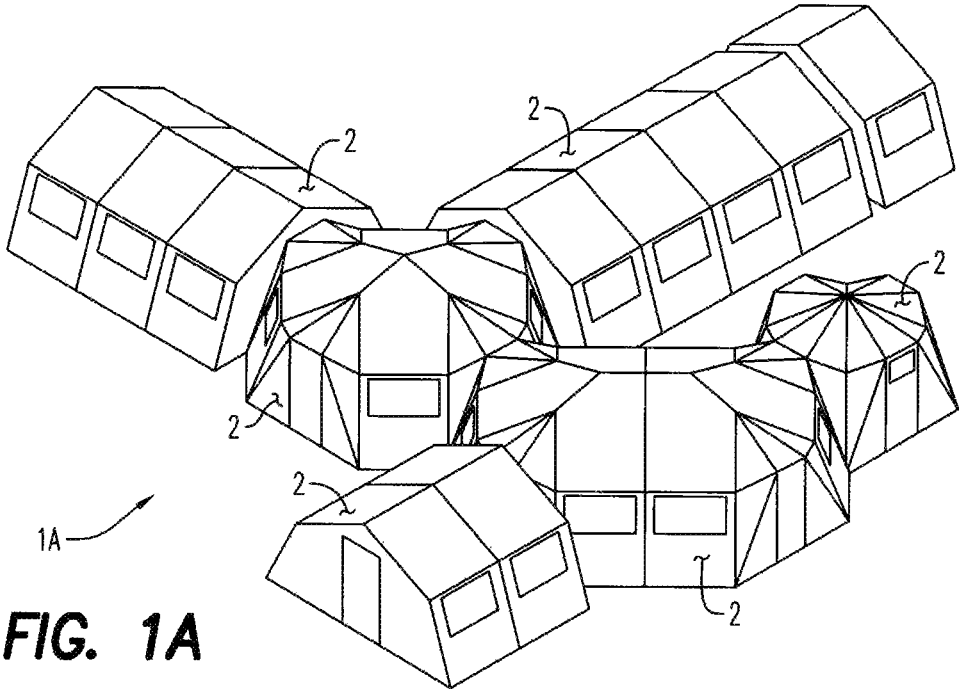
FIGS. 1A and 1B are perspective views of embodiments of collapsible shelters according to aspects of the present invention.
Figure 1B:
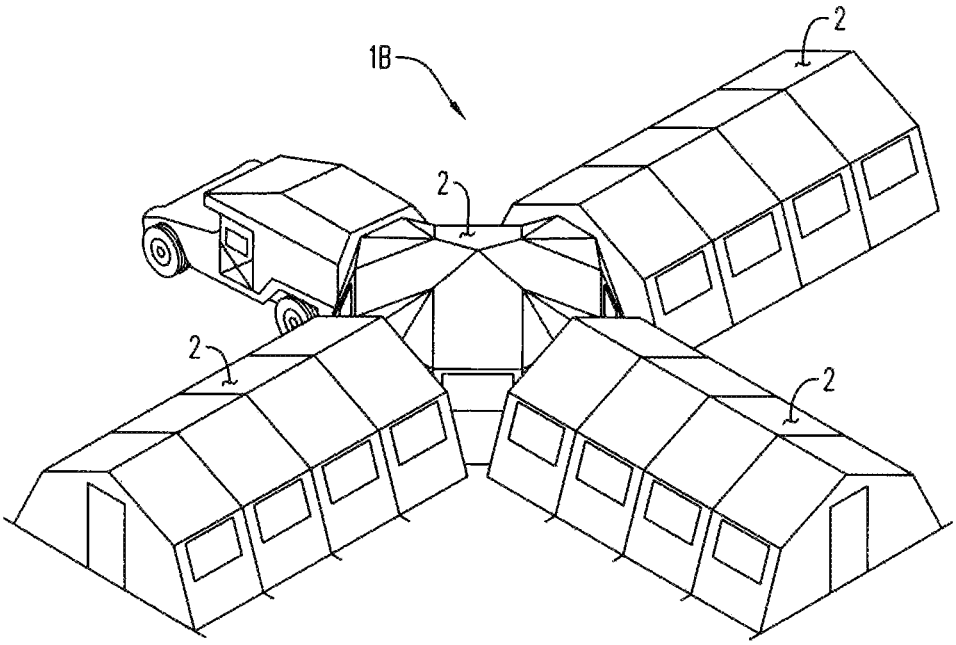
Figure 2:
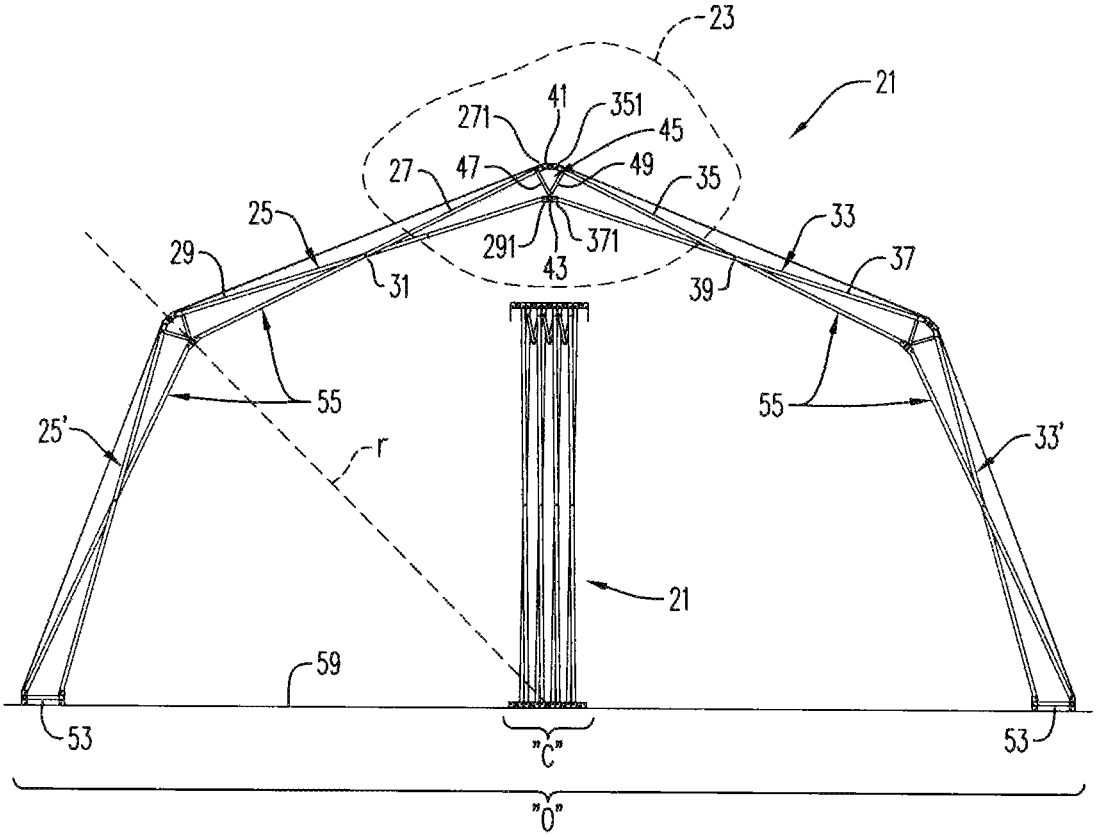
FIG. 2 is a front view of a collapsible structure according to an aspect of the present invention.

FIGS. 1A and 1B show embodiments of collapsible shelters 1A and 1B according to aspects of the present invention. The shelters 1A and 1B are shown with covers 2 attached. The shelters include collapsible structures 21 according to a further aspect of the present invention, an aspect of one of which is shown in FIG. 2. The collapsible structures 21 facilitate construction of collapsible shelters such as are shown for purposes of illustration and not limitation in FIGS. 1A and 1B. A substantially infinite number of configurations of collapsible shelters can be provided using the collapsible structures 21 and/or structural modules 23 of which they are made up.

The structure 21 comprises one or more structural modules 23, certain components of which are disposed within the area denoted by a dotted line in FIG. 2. Details of portions of structural modules are shown in FIGS. 3 and 4A-4C. A structural module 23 according to an aspect of the present invention comprises a first strut pair 25 comprising a first strut 27 and a second strut 29 pivotably connected to each other at a first strut pair pivotable connection point 31. The structural module 23 further comprises a second strut pair 33 comprising a third strut 35 and a fourth strut 37 pivotably connected to each other at a second strut pair pivotable connection point 39. The pivotable connection points 31 and 39 will ordinarily be formed by pins.

The structural module 23 further comprises a first hub 41 and a second hub 43. A first end 271 of the first strut 27 and a first end 351 of the third strut 35 are pivotably connected to the first hub 41, and a first end 291 of the second strut 29 and a first end 371 of the fourth strut 37 are pivotably connected to the second hub 43.

Figure 3:
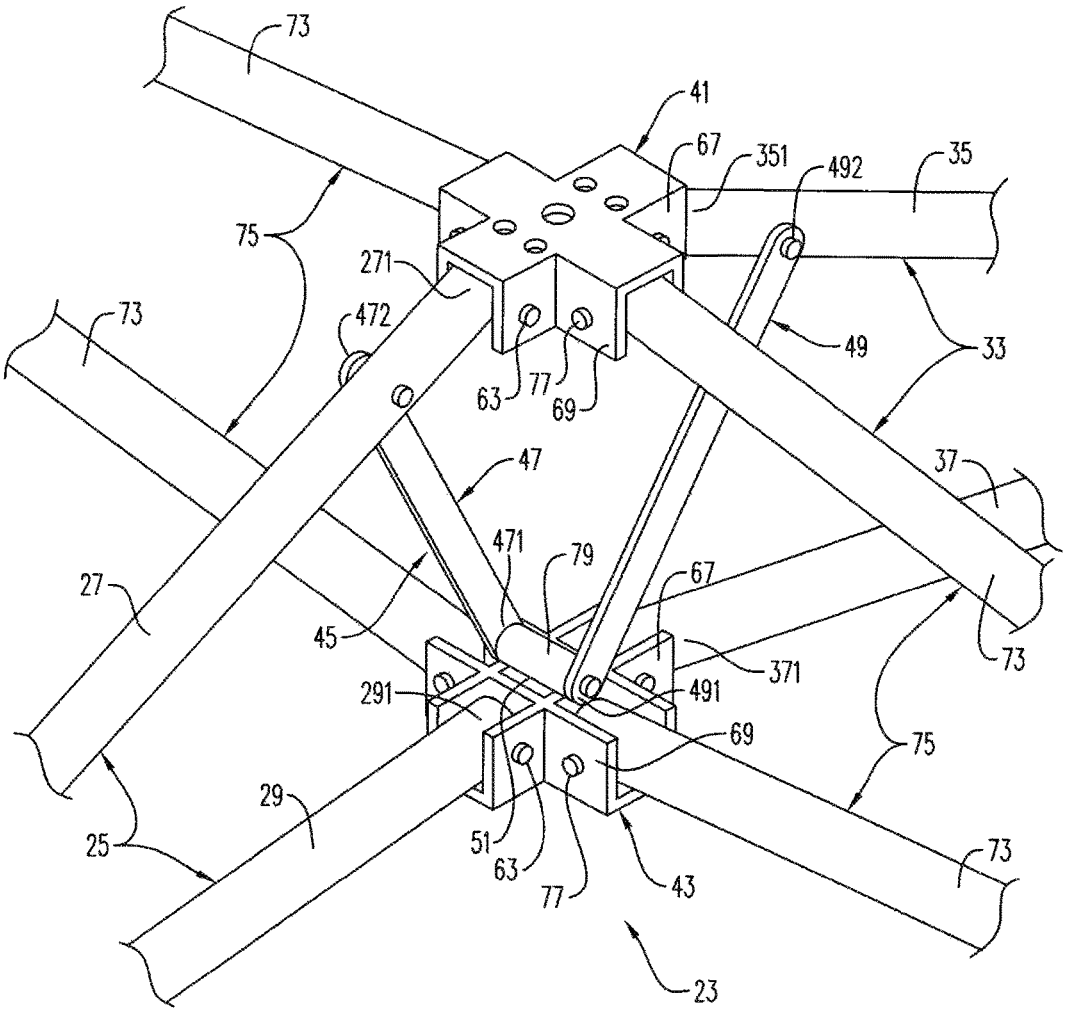
FIG. 3 is a perspective view of a portion of a collapsible structure according to an aspect of the present invention.
Figure 4B:
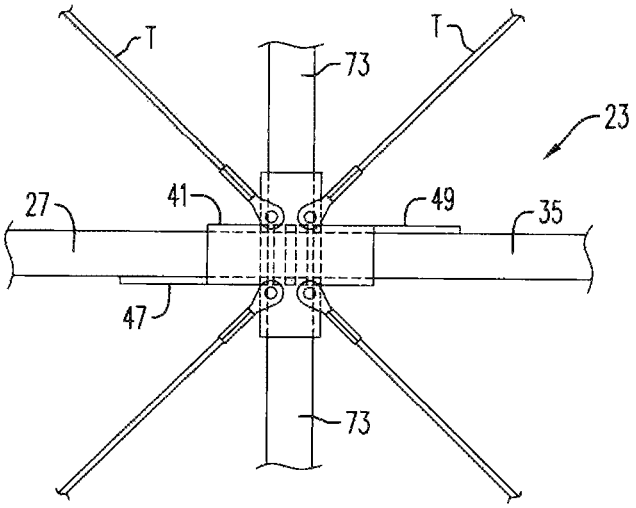
FIGS. 4B and 4C are views of the collapsible structure of FIG. 4A taken at sections 4B-4B and 4C-4C, respectively.
Figure 4A:
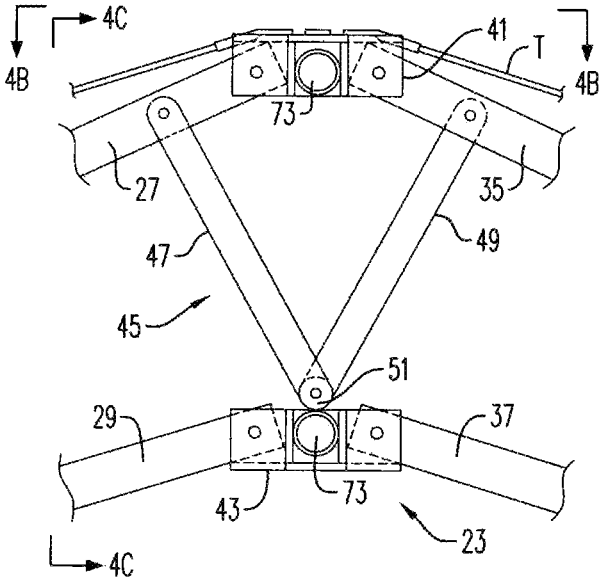
FIG. 4A is a side view of a portion of a collapsible structure according to an aspect of the present invention.
Figure 4C:
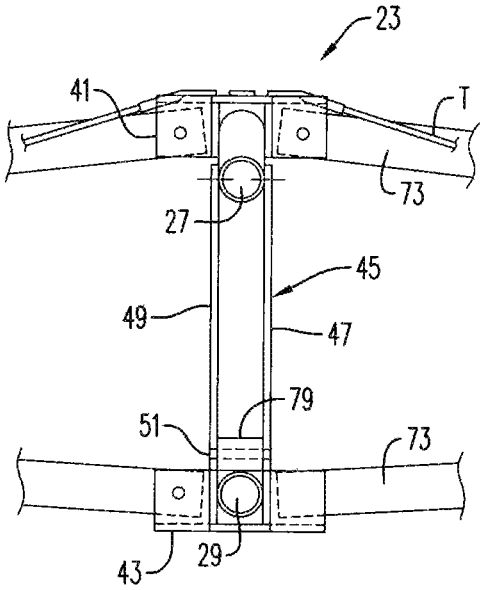

A stop 45 is provided and can, in one embodiment, comprise a first and a second stop strut 47 and 49, respectively. As seen in FIG. 3, the first and second stop strut 47 and 49 can be pivotably connected to each other proximate first ends 471 and 491 thereof to at least partially define an abutment end 51 of the stop. The first stop strut 47 can be pivotably connected at a second end 472 thereof to the first strut 27 and the second stop strut 49 can be pivotably connected at a second end 492 thereof to the third strut 35.

The structural module 23 is movable between a closed position (FIG. 5A and view "C" in FIG. 2) in which longitudinal axes of struts 27, 29 and 35, 37 of the first strut pair and the second strut pair 25 and 33 are substantially parallel to one another and an open position (FIG. 5D and view "O" in FIG. 2) in which the abutment end 51 of the stop 45 contacts the second hub 43. The abutment end 51 is not designed to be and does not need to be locked to the second hub 43, which facilitates erecting and folding the structure 21 and reduces the number of parts that can be damaged but, if desired, a locking connection (not shown) may be provided.

The structural module 23 is retained in an erected condition by means for limiting movement of the first and second strut pair pivotable connection points 31 and 39 relative to each other. The movement limiting means may take any number of forms but ordinarily includes at least some structure for holding distal ends 53 of a string 55 of two or more strut pairs 25, 33, 25', 33' in a fixed position relative to each other or for preventing the distal ends from moving away from each other. As seen, for example, in FIG. 5D, after a structure 21 comprising the string 55 of strut pairs is unfolded from the closed position (FIG. 5A), spread out (FIG. 5B) in a substantially flat condition, and raised from the flat, spread out condition to substantially a desired height (FIG. 5C) in which the abutment ends 51 of the stops 45 between each hub pair in the string contacts a corresponding hub, the distal ends 53 of the string 55 are fixed or prevented from moving apart, such as by securing them to the ground with stakes 57 extending through some suitable rigid or flexible attachment at the distal end of the string and thereby fixing the position of the distal ends relative to each other, by attaching a floor 59 or other tension member(s) such as cables between the distal ends to at least prevent them from moving apart, or by some combination of such illustrative measures. A floor 59 may be a rigid structure or, more typically, a flexible fabric structure that can be placed in tension. Fixing the distal ends 53 of the string 55 in this condition prevents the structure from automatically collapsing and functions as an alternative to, e.g., locking each strut pair in an open position. When it is desired to collapse the structure, this can be conveniently done by removing the structure for holding the distal ends of the string in the fixed position. Typically, hubs such as are used to connect two strut pairs are provided at the distal ends 53 of a string 55 of struts. A stop may be provided to limit movement of hubs of a pair of hubs at the distal ends 53 of the string 55 toward each other but, ordinarily, it is sufficient to hold the distal ends in a fixed position by, e.g., stakes, floors, and/or cables. A scissor-type stop such as can be used between two pairs of strut pairs is less useful at the distal ends 53 of the string 55 and, if a stop is provided, it is presently preferred to provide a stop such as a strut that extends from one hub to contact another hub of a hub pair at the distal end.

An outer cover 2 (FIGS. 1A and 1B) is ordinarily pre-attached to the string 55 at outer hubs along the string and functions as a tension member to assist in preventing the strut pairs of the string from opening beyond the point at which the abutment ends 51 of the stops 45 contact corresponding hubs. In addition, tension cables T (FIG. 2 and FIGS. 4A-4C) are typically provided and extend diagonally between hubs at diagonally opposite corners of squares defined by strut pairs on adjacent strings 55 of strut pairs and transverse strut pairs 75 between the adjacent strings of strut pairs. An inner cover (not shown) is ordinarily attached to inner hubs along the string at the time of erecting the structure 21 and also functions as a tension member to assist in preventing the strut pairs of the string from opening beyond the point at which the abutment ends 51 of the stops 45 contact corresponding hubs. While the inner cover and floor or cables attached to distal ends 53 of the string 55 can be preattached to the string 55, it is presently preferred to attach these components in the field to facilitate access to the struts and hubs forming the string 55 when erecting and collapsing the structure. The first and second hubs 41 and 43 are ordinarily provided with a centrally located hole for receiving a fastener for fastening an outer or inner cover to the hub, and with additional holes for receiving fasteners for securing the tension cables T.

Figure 6:
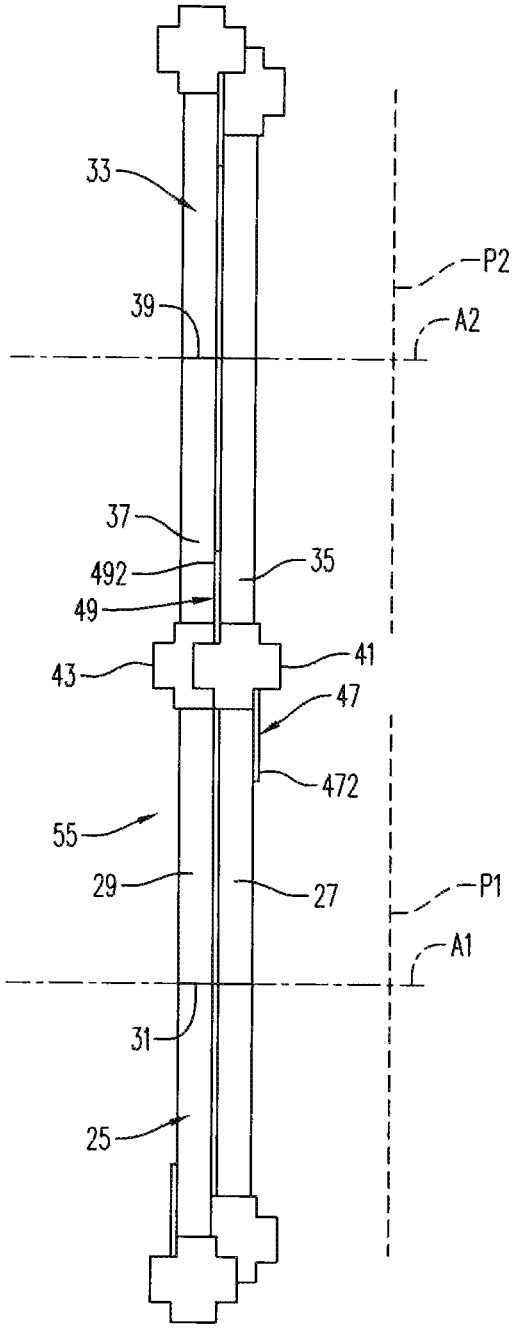
FIG. 6 is a schematic view of a top of a portion of a collapsible structure according to an aspect of the present invention.

As seen in a schematic top view of a string 55 of strut pairs as shown in FIG. 6, a first and a second pivot axis A1 and A2 extend through the first and the second strut pair 25 and 33 pivotable connection points 31 and 39, respectively, and a first and a second plane P1 and P2 perpendicular to the first and the second pivot axis, respectively, are parallel, or substantially so. Preferably, the struts of the strut pairs in a string 55 of strut pairs will have a certain amount of flexibility and will bend slightly so that the hubs of the hub pairs will be substantially aligned along radii r (FIG. 2) of the structure as seen in the top view of FIG. 4B which shows the first hub 41 completely obscuring the second hub (not seen in FIG. 4B) beneath it, as opposed to being offset by the thickness of the struts as shown in FIG. 6.

As seen, for example, in FIG. 2, in a given string 55 of strut pairs, the first strut pair 25 pivotable connection point 31 is ordinarily disposed along a middle half of each of the first and second struts 27 and 29, and the second strut pair 33 pivotable connection point 39 is also ordinarily disposed along a middle half of each of the third and fourth struts 35 and 37. If the pivotable connection points 31 and 39 are disposed at the midpoints of the struts 27, 29, 35, and 37, and the struts of a given strut pair are of equal length, the ends of the strut pairs will define corners of a rectangular shape when the strut pairs are in open positions. By offsetting the pivotable connection points 31 and 39 from the mid-points of the struts 27, 29, 35, and 37, when the strut pairs 25 and 33 are in an open position, the ends of the strut pairs can define corners of, for example, an isosceles trapezoidal shape as seen in FIG. 2, which facilitates forming an arch out of a string of strut pairs.

Figure 7:
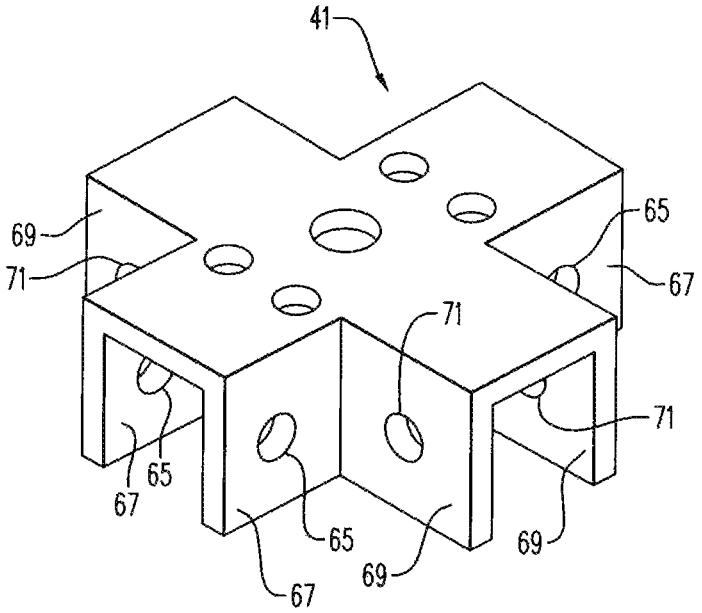
FIG. 7 is a perspective view of hubs of a hub pair according to an aspect of the present invention.
Figure 7:
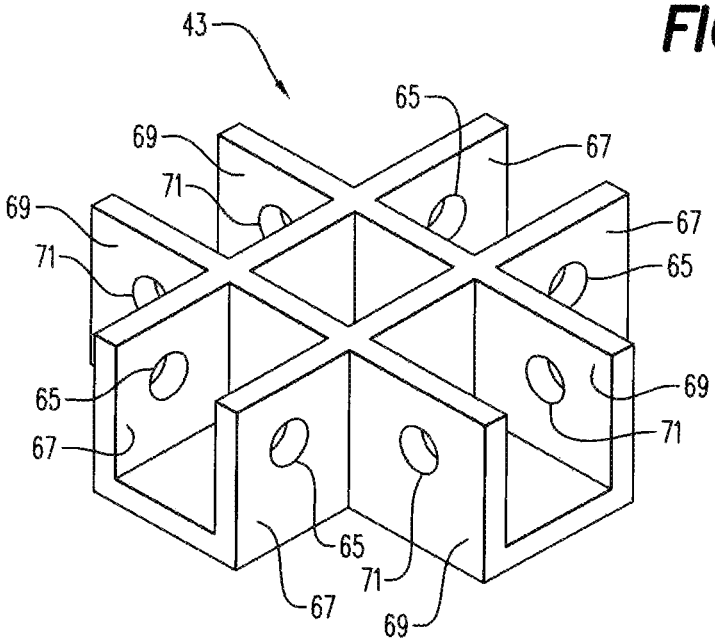

FIG. 3 shows a hub pair with struts 27, 29, 35, and 37 attached to hubs 41 and 43 of the pair via pins 63 that extend through holes 65 (FIG. 7) in legs 67 of the hubs. Each hub of a hub pair 61 can be identical to the other hub of the pair as seen, for example, in FIG. 7. Ordinarily, each hub in each hub pair in a string of strut pairs is identical to every other hub in the string. As seen in FIGS. 3 and 7, transverse legs 69 of the hubs 41 and 43, which may be identical to the legs 65, are likewise provided with holes 71. Ends of transverse struts 73 of transverse strut pairs 75 can be pivotably attached to the transverse legs 69 via pins 77 (FIG. 3). The transverse struts 73 will ordinarily be scissor struts attached to each other by pins (not shown) like the struts of the strut pairs 25 and 33, and will ordinarily, but not necessarily, be joined to each other at midpoints of the struts so that the strut pairs form a rectangular shape when in an open position. It is also possible to omit any structure that joins the transverse struts 73, i.e., they need not be pinned together. Ordinarily, no stop struts are attached to the transverse struts 73, and the extent to which the transverse strut pair 75 can be opened will ordinarily be limited by the extent to which non-transverse strut pairs with stops 45 attached thereto permit.

Figure 8A:
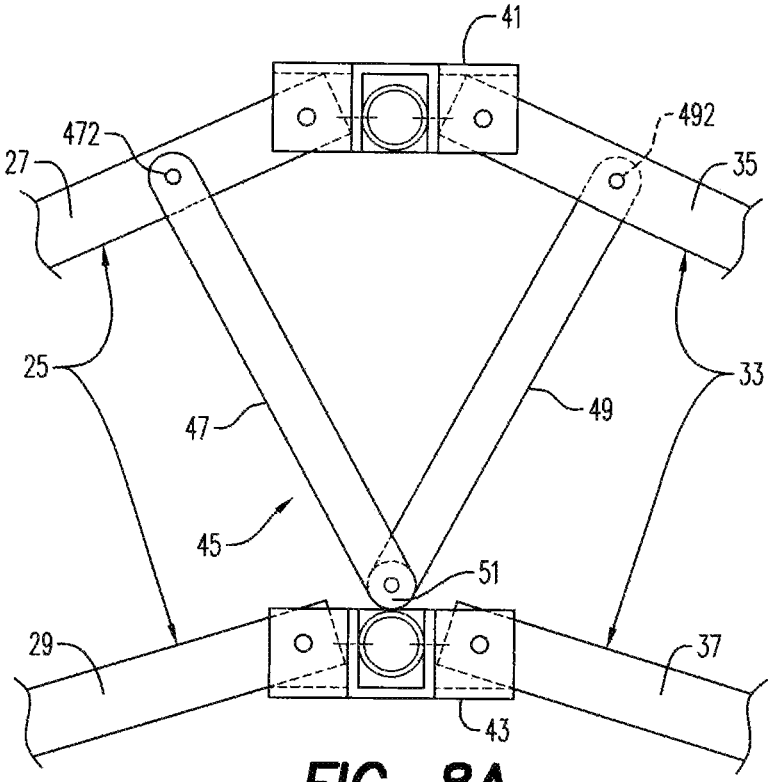
FIGS. 8A and 8B are side views of a portion of a collapsible structure according to an aspect of the present invention in an open and a folded condition.
Figure 8B:
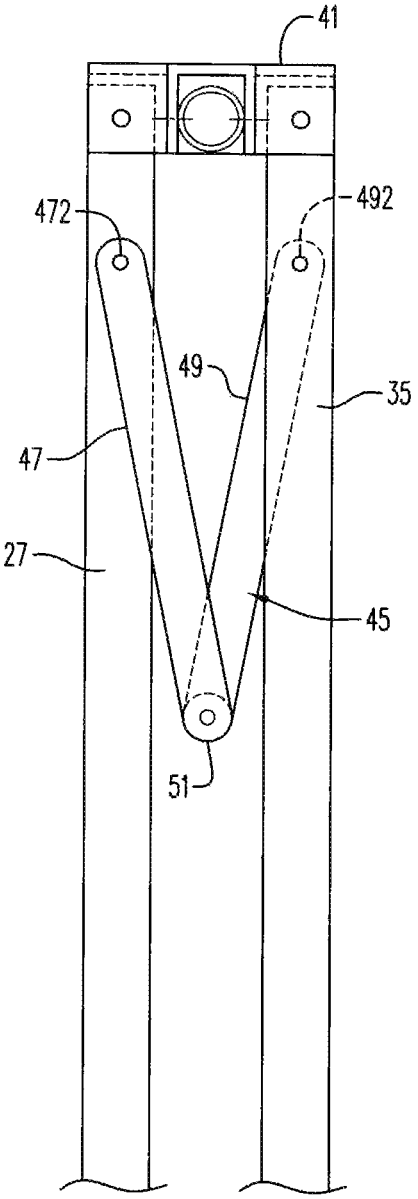

FIGS. 8A and 8B show a hub pair connecting two strut pairs 25 and 33 that are both in the form of isosceles trapezoids when in the open position (FIG. 8A). The second end 472 of the first stop strut 47 is connected to the first strut 27 and the second end 492 of the second stop strut 49 is connected to the third strut 35 at the same distance from the first hub 41. The first and second stop struts 47 and 49 are both the same length. When the strut pairs are folded to a collapsed position in which the struts are all substantially parallel, as shown in FIG. 8B, the abutment end 51 of the stop 45 is disposed evenly between the first and third struts 27 and 35, facilitating closing of the structure.

Figure 9A:
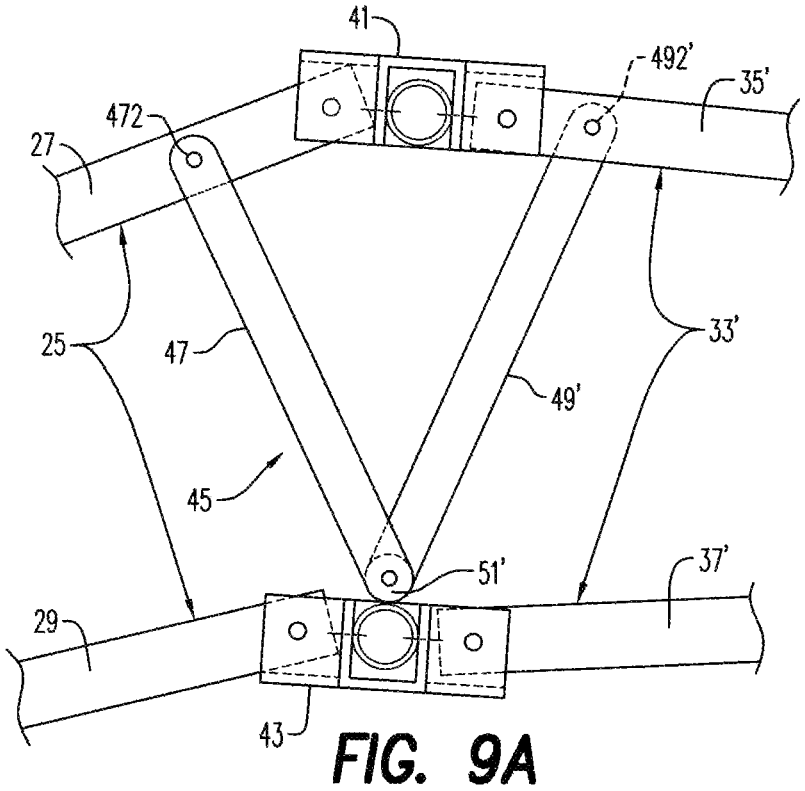
FIGS. 9A and 9B are side views of a portion of a collapsible structure according to an another aspect of the present invention in an open and a folded condition.
Figure 9B:
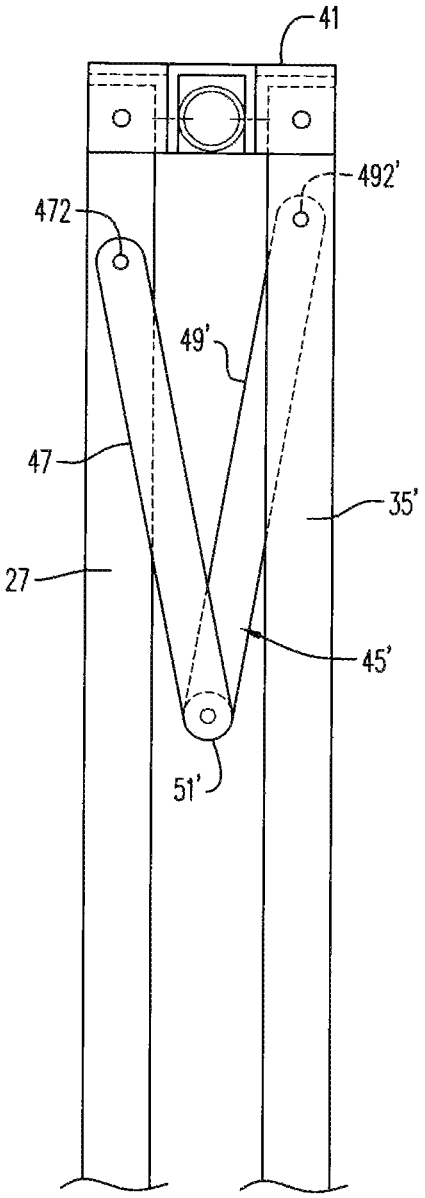

A somewhat different structure has been found to be useful when connecting two strut pairs that have different shapes when in an open position, such as different isosceles trapezoids or isosceles trapezoids attached to rectangles. FIGS. 9A and 9B show a hub pair connecting two strut pairs wherein one strut pair 25 is in the form of an isosceles trapezoid in the open position and the other strut pair 33' is in the form of a rectangle in the open position. In this arrangement, the second end 472 of the first stop strut 47 is connected to the first strut 27 and the second end 492' of the second stop strut 49' is connected to the third strut 35' at different distances from the first hub, and the first and second stop struts are different lengths. By appropriate selection of the distances, the abutment end 51' of the stop 45' can be disposed evenly between the first and third struts 27 and 35', facilitating proper closing of the structure. If some suitable measure such as altering the length of the stop struts and the point of connection of the second ends of the stop struts to the first and third struts were not taken, the stop might interfere with proper closure of the strut pairs.

As seen, for example, in FIGS. 3 and 6, the second end 472 of the first stop strut 47 can be pivotably attached to what may be denominated as a front side of the first strut 27 (to the left in FIG. 3 and to the right in FIG. 6, and the second end 492 of the second stop strut 492 can be pivotably attached to what can be denominated as a rear side of the third strut 35 (to the right in FIG. 3 and to the left in FIG. 6). It will be appreciated that which side of the strut is denominated as the "front" and which is denominated as the "rear" need not be essential to the invention and the terms are used merely to provide a frame of reference. As seen in FIG. 3, the stop 45 can comprise a spacer 79 disposed between the first ends 471 and 491 of the first and second stop strut 47 and 49. The spacer 51 can at least partially define the abutment end 51 of the stop and can contact the second hub 43 when the structural module is in the open position.

In the embodiment of the structure 21 and structural module 23 shown in, e.g., FIGS. 2 and 3, the first and second stop strut 47 and 49 and the first and third strut 27 and 35 define a convex quadrilateral shape (e.g., a diamond) when the structural module is in the open position. Other stop structures can be provided, however, as illustrated by the stop 45' shown in the structural module 23' in FIG. 10, in which the first and second stop strut 47' and 49' and the first and third strut 27' and 35' (in the position of the second and fourth strut 29 and 37 of the embodiment of FIGS. 2 and 3) define a concave quadrilateral shape when the structural module is in the open position and the abutment surface 51' of the stop contacts the second hub 43' (in the position of the first hub 41 of the embodiment of FIGS. 2 and 3).

Figure 10:
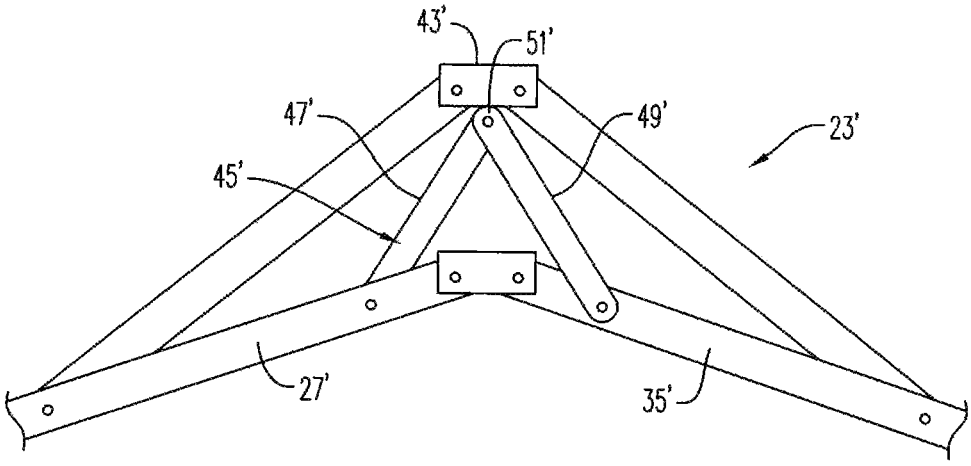
FIG. 10 is a side view of a portion of a collapsible structure according to another aspect of the present invention.

While a scissor-type stop such as the stop 45 shown in, e.g., FIGS. 2 and 3 or the stop 45' shown in FIG. 10 is presently preferred, other stop structures can also be provided. A stop according other aspects of the invention can be in the form of, for example, a post extending from a center of one hub of a hub pair that is intended to abut in, preferably, a non-locking fashion with the other hub of the hub pair to limit the extent to which the hubs of the hub pair can move toward each other, and thus limit the extent to which the ends of the struts of the associated strut pairs attached to the hubs of the hub pair can move toward each other. The use of the illustrated scissor structures 45 and 45', however, is believed to be useful to ensure that the abutment surface 51 and 51' of the stops contacts the associated second hub 43

While the invention has been primarily described in connection with structures 21 in the form of arches of two or more strut pairs arranged substantially in a row, other structures can be provided in which strings of two or more strut pairs comprising stops arranged between each strut pair are joined end-to-end at angles to each other, which can facilitate construction of shelters having more complex shapes than simple arches. At the intersection of the strings, different stop arrangements may be appropriate depending upon the particular structure sought to be constructed. Where, for example, a scissor-type stop such as is shown in FIG. 2 is not possible, a stop may be in the form of a rigid member that extends from one hub to contact another hub of a hub pair at the intersection of the strings.

A method of erecting a collapsible structure is shown in FIGS. 5A-5D and described in connection with the collapsible structure 21 of the type shown in FIG. 2. The collapsible structure 21 comprises a plurality of strut pairs 25, 33, 25', 33'. Each strut pair 25, 33, 25', 33' comprises a front strut and a rear strut pivotably connected to each other at a strut pair pivotable connection point. The structure 21 further includes a plurality of hub pairs, each hub pair comprising an outer hub 41 (FIG. 2) and an inner hub 43 (FIG. 2), at least one first hub pair of the plurality of hub pairs being connected to at least a first and a second strut pair of the plurality of strut pairs to form a series or string 55 of strut pairs so that an outer hub of the at least one first hub pair is pivotably connected to front struts of the first and second strut pair and an inner hub of the at least one first hub pair is pivotably connected to rear struts of the first and second strut pair. The structure 21 further includes a stop 45 associated with at the at least one first hub pair, the stop comprising a first and a second stop strut 47, 49 (FIG. 2) pivotably connected to each other proximate first ends thereof, the first and the second stop strut being pivotably connected at second ends thereof to one of the front strut and the rear strut of the first and second strut pair, respectively.

Figure 5A:
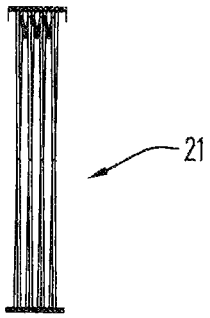
FIGS. 5A-5D show steps in the erection of a collapsible structure in a method according to an aspect of the present invention.
Figure 5B:
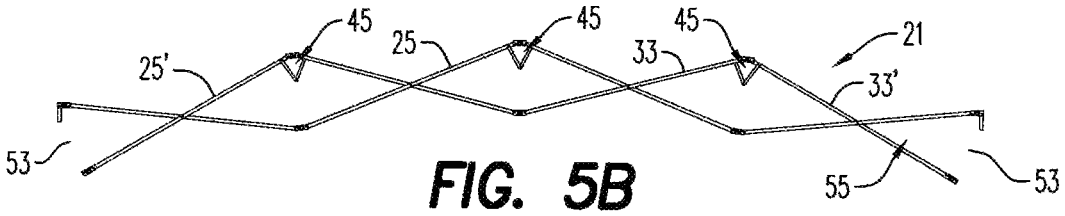
Figure 5C:
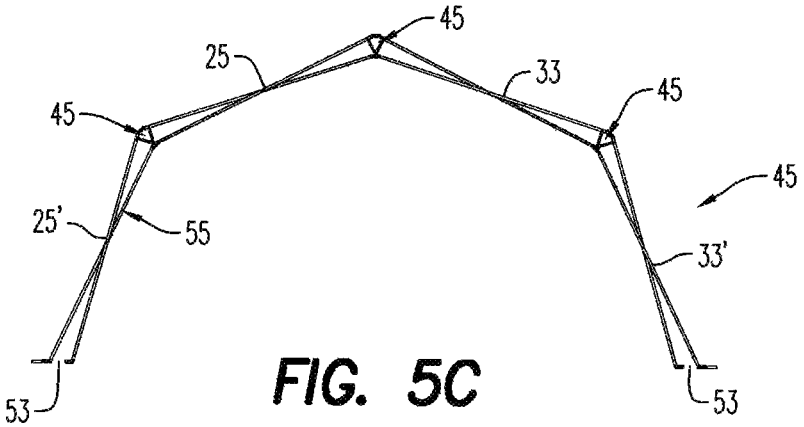
Figure 5D:
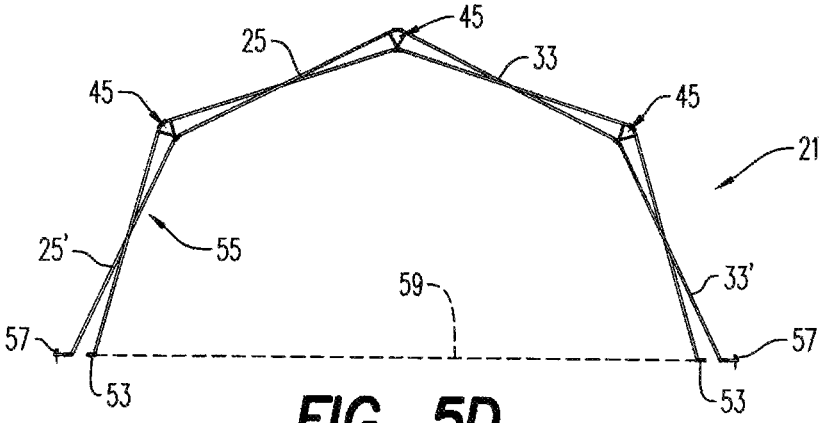

According to the method, each strut pair 25, 33, 25', 33' is moved from a collapsed position as seen in FIG. 5A in which the front and rear strut of each strut pair are substantially parallel to each other and hubs of the first hub pair are at a greatest possible distance from each other to an open position shown in FIGS. 5C and 5D in which the stop prevents hubs of the first hub pair from moving closer to each other. From the collapsed position shown in FIG. 5A, the string 55 is unfolded as shown in FIG. 5B so that the hubs of each hub pair move closer to each other, and the struts of the strut pairs are moved from being substantially parallel through a position in which they are perpendicular and toward a position in which they would again be parallel. After each strut pair 25, 33, 25', 33' is in an open position as seen in FIG. 5C, relative movement of the strut pairs of the series 55 of strut pairs is restrained without locking inner and outer hubs to each other, such as by securing distal ends 53 of the string in a fixed position relative to each other, such as by means of stakes 57, and/or by preventing movement of the distal ends away from each other, such as by means of cables and/or floors 59.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. A structural module, comprising:

a first strut pair comprising a first strut and a second strut pivotably connected to each other at a first strut pair pivotable connection point disposed in a middle half of each of the first strut and the second strut;

a second strut pair comprising a third strut and a fourth strut pivotally connected to each other at a second strut pair pivotable connection point disposed in a middle half of each of the third strut and the fourth strut;

a first hub, a first end of le first strut and a first end of the third strut being pivotably connected to the first hub;

a second hub, a first end of the second strut and a first end of the fourth strut being pivotably connected to the second hub; and a stop having a first end that at least partially defines an abutment end of the stop, and a second end pivotably connected to the first strut and to the third strut, wherein the structural module is movable between a closed position in which the abutment end of the stop is spaced from the second hub and there is nothing connecting the first and second hub except the first and second strut pair and an open position in which the abutment end of the stop contacts the second hub, the stop comprises a first and a second stop strut pivotably connected to each other proximate first ends thereof to at least partially define the abutment end of the stop, the first stop strut being pivotably connected at a second end thereof to the first strut and the second stop strut being pivotably connected at a second end thereof to the third strut, the structural module is movable between the closed position in which longitudinal axes of struts of the first strut pair and the second strut pair are substantially parallel to one another and the open position in which the abutment end of the stop contacts the second hub, and the first and second stop strut and the first and third strut define a convex quadrilateral shape when the structural module is in the open position.

2. The structural module as set forth in claim 1, comprising means for limiting movement of the first and second strut pair pivotable connection points relative to each other.

3. The structural module as set forth in claim 2, wherein the movement limiting means comprises at least one of stakes for pinning distal ends of a string of strut pairs comprising the first and second strut pair in fixed positions relative to each other and tension members arranged between distal ends of the string of strut pairs to prevent the distal ends from moving away from each other.

4. The structural module as set forth in claim 1, wherein a first and a second pivot axis extends through the first and the second strut pair pivotable connection points, respectively, and a first and a second plane perpendicular to the first and the second pivot axis, respectively, are parallel.

5. A structural module, comprising:

a first strut pair comprising a first strut and a second strut pivotably connected to each other at a first strut pair pivotable connection point;

a second strut pair comprising a third strut and a fourth strut pivotably connected to each other at a second strut pair pivotable connection point;

a first hub, a first end of the first strut and a first end of the third strut being pivotably connected to the first hub;

a second hub, a first end of the second strut and a first end of the fourth strut being pivotably connected to the second hub; and a stop comprising a first and a second stop strut pivotably connected to each other proximate first ends thereof to at least partially define an abutment end of the stop, the first stop strut being pivotably connected at a second end thereof to the first strut and the second stop strut being pivotably connected at a second end thereof to the third strut, wherein the structural module is movable between a closed position in which longitudinal axes of struts of the first strut pair and the second strut pair are substantially parallel to one another and an open position in which the abutment end of the stop contacts the second hub, and wherein the second end of the first stop strut is connected to the first strut and the second end of the second stop strut is connected to the third strut at different distances from the first hub.

6. The structural module as set forth in claim 5, wherein the first stop strut and the second stop strut are of different length.

7. A structural module, comprising:

a first strut pair comprising a first strut and a second strut pivotably connected to each other at a first strut pair pivotable connection point;

a second strut pair comprising a third strut and a fourth strut pivotably connected to each other at a second strut pair pivotable connection point;

a first hub, a first end of the first strut and a first end of the third strut being pivotably connected to the first hub;

a second hub, a first end of the second strut and a first end of the fourth strut being pivotably connected to the second hub; and a stop comprising a first and a second stop strut pivotably connected to each other proximate first ends thereof to at least partially define an abutment end of the stop, the first stop strut being pivotably connected at a second end thereof to the first strut and the second stop strut being pivotably connected at a second end thereof to the third strut, wherein the structural module is movable between a closed position in which longitudinal axes of struts of the first strut pair and the second strut pair are substantially parallel to another and an open position in which the abutment end of the stop contacts the second hub, and wherein the first stop strut and the second stop strut are of different length.

8. A structural module, comprising:

a first strut pair comprising a first strut and a second strut pivotably connected to each other at a first strut pair pivotable connection point disposed in a middle half of each of the first strut and the second strut;

a second strut pair comprising a third strut and a fourth strut pivotably connected to each other at a second strut pair pivotable connection point disposed in a middle half of each of the third strut and the fourth strut;

a first hub, a first end of the first strut and a first end of the third strut being pivotably connected to the first hub;

a second hub, a first end of the second strut and a first end of the fourth strut being pivotably connected to the second hub; and a stop having a first end that at least partially defines an abutment end of the stop, and a second end pivotably connected to the first strut and to the third strut, wherein the structural module is movable between a closed position in which the abutment end of the stop is spaced from the second hub and there is nothing connecting the first and second hub except the first and second strut pair and an open position in which the abutment end of the stop contacts the second hub, wherein the stop comprises a first and a second stop strut pivotably connected to each other proximate first ends thereof to at least partially define the abutment end of the stop, the first stop strut being pivotably connected at a second end thereof to the first strut and the second stop strut being pivotably connected at a second end thereof to the third strut, wherein the structural module is movable between the closed position in which longitudinal axes of struts of the first strut pair and the second strut pair are substantially parallel to one another and the open position in which the abutment end of the stop contacts the second hub, and wherein the second end of the first stop strut is pivotably attached to a front side of the first strut and the second end of the second stop strut is pivotably attached to a rear side of the third strut.

9. The structural module as set forth in claim 8, wherein the stop comprises a spacer disposed between the first ends of the first and second stop strut.

10. The structural module as set forth in claim 9, wherein the spacer contacts the second hub when the structural module is in the open position.

11. A structural module, comprising:

a first strut pair comprising a first strut and a second strut pivotably connected to each other at a first strut pair pivotable connection point disposed in a middle half of each of the first strut and the second strut;

a second strut pair comprising a third strut and a fourth strut pivotably connected to each other at a second strut pair pivotable connection point disposed in a middle half of each of the third strut and the fourth strut;

a first hub, a first end of the first strut and a first end of the third strut being pivotably connected to the first hub;

a second hub, a first end of the second strut and a first end of the fourth strut being pivotably connected to the second hub; and a stop having a first end that at least partially defines an abutment end of the stop, and a second end pivotably connected to the first strut and to the third strut, wherein the structural module is movable between a closed position in which the abutment end of the stop is spaced from the second hub and an open position in which the abutment end of the stop contacts the second hub, and wherein the stop comprises a first and a second stop strut pivotably connected to each other proximate first ends thereof to at least partially define the abutment end of the stop, the first stop strut being pivotably connected at a second end thereof to the first strut and the second stop strut being pivotably connected at a second end thereof to the third strut, wherein the structural module is movable between the closed position in which longitudinal axes of struts of the first strut pair and the second strut pair are substantially parallel to one another and the open position in which the abutment end of the stop contacts the second hub, and wherein the first and second stop strut and the first and third strut define a concave quadrilateral shape when the structural module is in the open position.

12. A collapsible structure, comprising:

a plurality of strut pairs, each strut pair comprising a front strut and a rear strut pivotably connected to each other at a strut pair pivotable connection point disposed in a middle half of each of the front strut and the rear strut;

a plurality of hub pairs, each hub pair comprising an outer hub and an inner hub;

at least one first hub pair of the plurality of hub pairs being connected to at least a first and a second strut pair of the plurality of strut pairs so that an outer hub of the at least one first hub pair is pivotably connected to front struts of the first and second strut pair and an inner hub of the at least one first hub pair is pivotably connected to rear struts of the first and second strut pair; and a stop associated with at the at least one first hub pair, the stop comprising a first end pivotably connected to one of either the front struts of the first and second strut pair or to the rear struts of the first and second strut pair, and a second end at least partially defining an abutment end of the stop, the collapsible structure being movable to a closed position in which the abutment end of the stop is spaced from the second hub and there is nothing connecting the first and second hub except struts of the plurality of strut pairs and to an open position in which the abutment end of the stop contacts one of the inner and outer hub of the at least one first hub pair, wherein the stop comprises a first and a second strop strut pivotably connected to each other proximate first ends thereof, the first ends of the first and second stop strut at least partially defining the abutment end of the stop, and the collapsible structure is movable between a closed position in which longitudinal axes of struts of the first strut pair and the second strut pair are substantially parallel to one another and the open position in which the abutment end of the stop contacts the one of the inner and the outer hub of the at least one first hub pair.

13. The collapsible structure as set forth in claim 12, comprising at least two second hub pairs of the plurality of hub pairs each connected to a respective one of the first and the second strut pair at opposite ends of the first and second strut pair from the first hub pair, an inner hub of each of the at least two second hub pairs being pivotably connected to a rear strut of the respective one of the first and second strut pair and an outer hub of each of the at least two second hub pairs being pivotably connected to a respective front strut of the respective one of the first and second strut pair.

14. The collapsible structure as set forth in claim 13, comprising a stop associated with a respective one of each of the first and second hub pairs.

15. The collapsible structure as set forth in claim 12, comprising means for limiting movement of strut pair pivotable connection points relative to each other.

* * * * *